US010876797B2

(12) United States Patent
Townsend et al.

(10) Patent No.: US 10,876,797 B2
(45) Date of Patent: Dec. 29, 2020

(54) HEAT TRANSFER SYSTEM

(71) Applicant: Craig Technical Consulting, Inc., Merritt Island, FL (US)

(72) Inventors: Ivan Townsend, Kennedy Space Center, FL (US); Philip Metzger, Kennedy Space Center, FL (US); Robert Mueller, Kennedy Space Center, FL (US); Jason Menzies, Kennedy Space Center, FL (US); James Mantovani, Kennedy Space Center, FL (US)

(73) Assignee: Craig Technical Consulting, Inc., Merritt Island, FL (US)

( * ) Notice: Subject to any disclaimer, the term of this patent is extended or adjusted under 35 U.S.C. 154(b) by 79 days.

(21) Appl. No.: 16/377,963

(22) Filed: Apr. 8, 2019

(65) Prior Publication Data

US 2019/0310024 A1 Oct. 10, 2019

Related U.S. Application Data

(60) Provisional application No. 62/654,959, filed on Apr. 9, 2018.

(51) Int. Cl.

| | |
|---|---|
| ***F28D 15/00*** | (2006.01) |
| ***F28F 23/00*** | (2006.01) |
| *F28D 21/00* | (2006.01) |

(52) U.S. Cl.
CPC ..... *F28D 15/00* (2013.01); *F28F 23/00* (2013.01); *F28D 2021/0021* (2013.01)

(58) Field of Classification Search
CPC ..... F28D 15/00; F28D 2021/0021; F28D 21/0001; F28D 2021/0045; F28F 23/00; F28C 3/12
See application file for complete search history.

(56) References Cited

U.S. PATENT DOCUMENTS

2008/0173533 A1* 7/2008 Mankins ..... C01B 3/32 204/157.15
2016/0045841 A1* 2/2016 Kaplan ..... B01D 3/06 429/49

* cited by examiner

*Primary Examiner* — Emmanuel E Duke
(74) *Attorney, Agent, or Firm* — Mark Malek; Kelly G. Swartz; Widerman Malek, PL

(57) ABSTRACT

A system for heat transfer including a compressor, a regolith inlet, a first storage hopper, and a load. The compressor is in fluid communication with a closed loop system. The regolith inlet is in fluid communication with the closed loop system. The first storage hopper is adapted to carry an amount of regolith and is in fluid communication with the regolith inlet. The load is in fluid communication with the closed loop system between a compressor inlet a compressor outlet.

20 Claims, 4 Drawing Sheets

HEAT TRANSFER SYSTEM

RELATED APPLICATIONS

This application claims the benefit under 35 U.S.C. § 119(e) of U.S. Provisional Patent Application Ser. No. 62/654,959 titled SYSTEM AND METHOD FOR UTILIZING DUST AS A ZERO-G WORKING FLUID filed on Apr. 9, 2018, the entire content(s) of which is/are incorporated herein by reference.

GOVERNMENT INTEREST

The invention described herein was made in the performance of work under a NASA contract NNK11EA08C and by employees of the United States Government and is subject to the provisions of Public Law 96-517 (35 U.S.C. § 202) and may be manufactured and used by or for the Government for governmental purposes without the payment of any royalties thereon or therefore.

FIELD OF THE INVENTION

The present invention relates to systems and methods for utilizing dust as a zero-g working fluid and, more particularly, to a pneumatic conveyance of regolith dust through a heat exchanger loop to heat regolith dust and move heated regolith dust to another location where heat is removed and used as energy.

BACKGROUND

Regolith may be used as a heat transfer substance in a radiator device. The use of regolith as a heat transfer substance may be particularly beneficial during aerospace missions because the use of regolith for heat transfer may free up cargo space and reduce mass on the aerospace vehicle payloads. Additionally, regolith may be readily available during aerospace missions at locations where water, air, or other conventional coolants may be scarce. Regolith is a solid granular material (with a higher heat capacity than a motive gas) and provides advantages to storing and transferring heat compared to using just a fluid or gas alone. Therefore, a need exists for a radiator device using regolith as a heat transfer medium.

SUMMARY OF THE INVENTION

With the above in mind, embodiments of the present invention are related to a system for heat transfer including a compressor, an amount of regolith, a regolith inlet, a first storage hopper, and a load. The compressor may be in fluid communication with a closed loop system. The regolith inlet may be in fluid communication with the closed loop system. The first storage hopper may be adapted to carry the amount of regolith and may be in fluid communication with the regolith inlet. The load may be in fluid communication with the closed loop system between a compressor inlet a compressor outlet.

The system for heat transfer may also include a cyclonic separator in fluid communication with the closed loop system between an outlet of the load and the compressor inlet.

The first storage hopper may be in fluid communication with an outlet of the cyclonic separator.

The system for heat transfer may include an energy harvest system in fluid communication with an outlet of the cyclonic separator. The energy harvest system may include a second storage hopper, which may be insulated, a valve, an energy transfer device, and a helical tube coil. The second storage hopper may be in direct fluid communication with the outlet of the cyclonic separator. The valve may be in direct fluid communication with an outlet of the second storage hopper. The energy transfer device may be adapted to convert a heat energy of the amount of regolith to another form of energy.

The system for heat transfer may also include a fine particle filter in fluid communication with the closed loop system.

The system for heat transfer may further include a seven-pass tube bank in fluid communication with the closed loop system. The seven-pass tube bank may be located within the load.

The regolith inlet may include a venturi educator or a volumetric feeder.

DETAILED DESCRIPTION OF THE INVENTION

Figure 1:
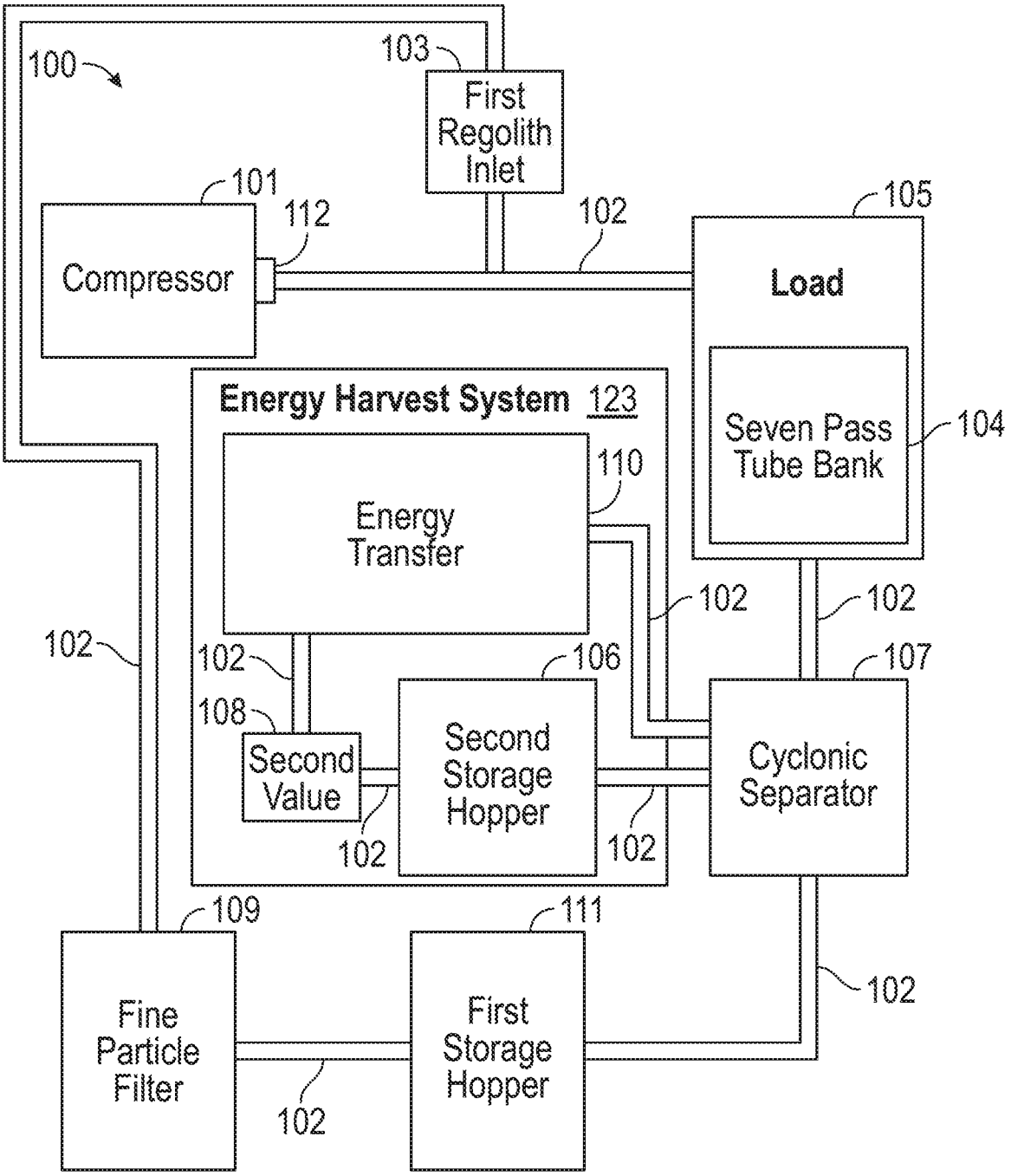
FIG. 1 is a block diagram of the regolith radiator system for heat transfer according to an embodiment of the present invention.
Figure 2:
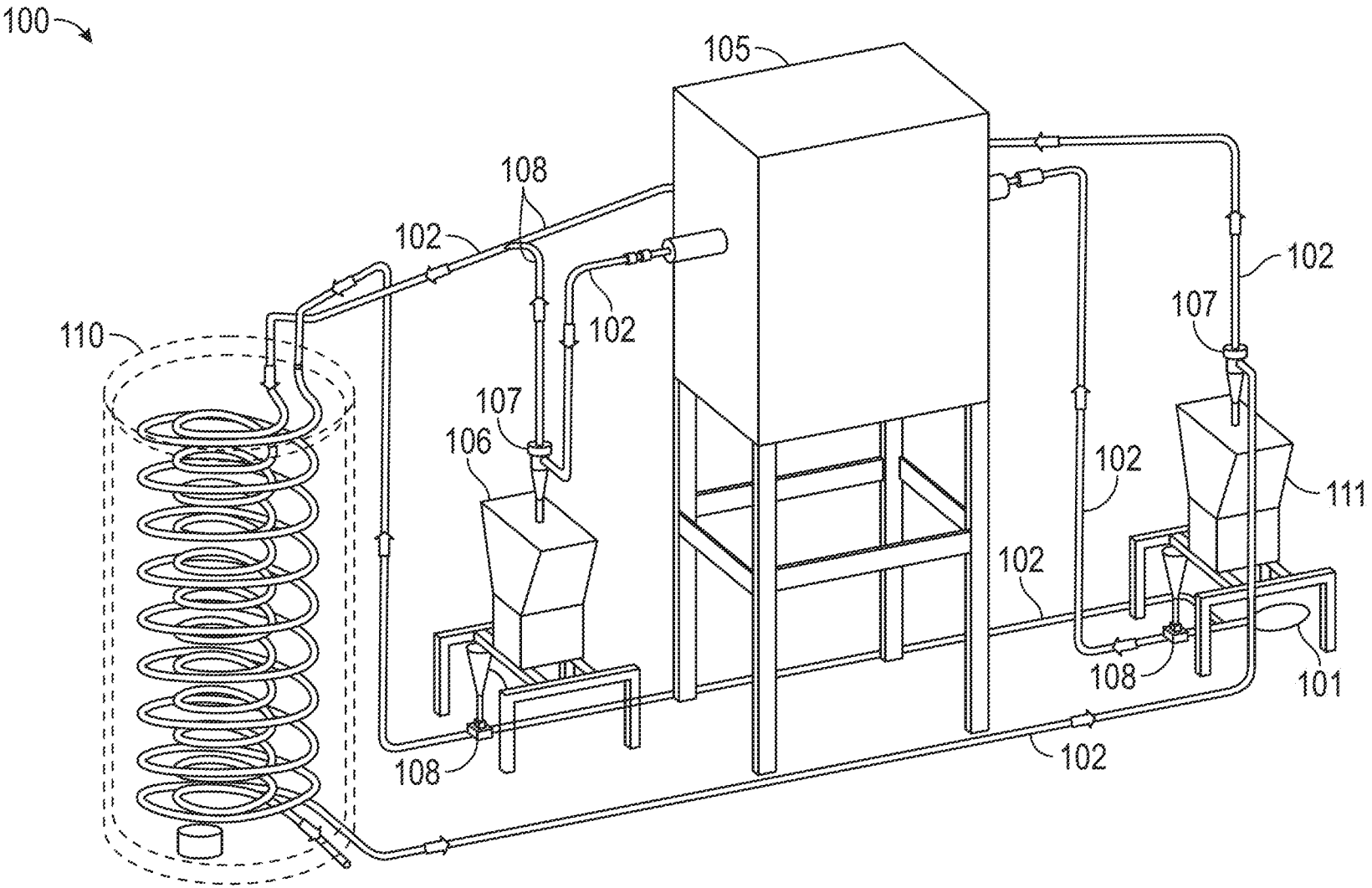
FIG. 2 is a diagram of the regolith radiator system for heat transfer according to an embodiment of the present invention.
Figure 3:
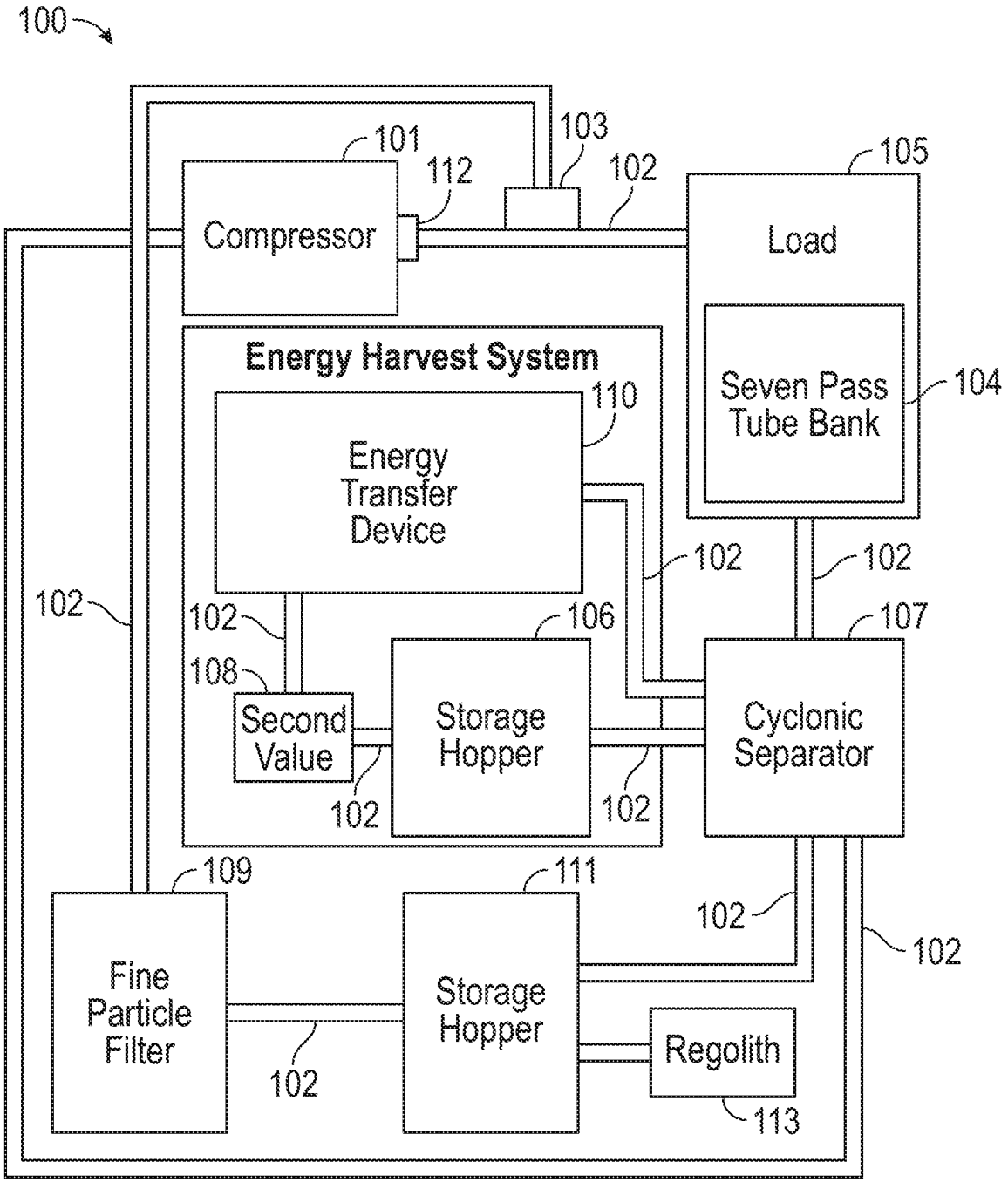
FIG. 3 is block diagram of the regolith radiator system for heat transfer according to an embodiment of the present invention.
Figure 4:
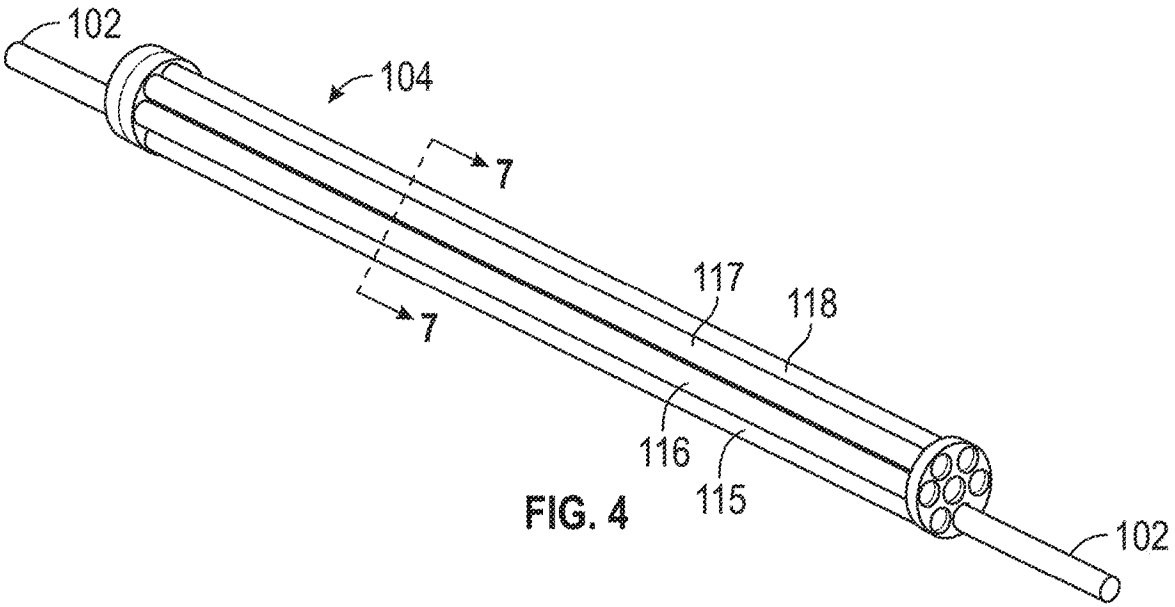
FIG. 4 is a perspective view of the seven-pass tube bank of the regolith radiator system of FIGS. 1-3.
Figure 7:
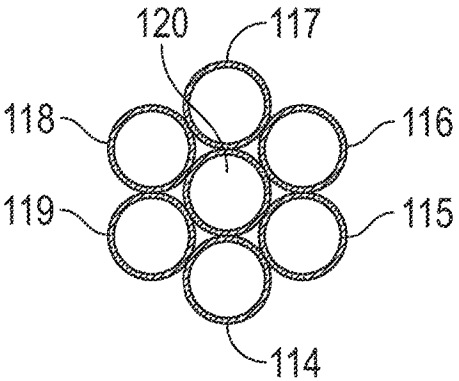
FIG. 7 is a cross-section view of the seven-pass tube bank taken through line 7-7 of FIG. 4.
Figure 6:
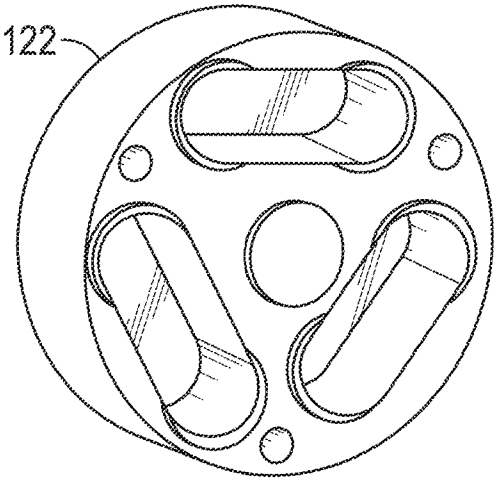
FIG. 6 is a rear perspective view of a second cap at the second end of the seven-pass tube bank of FIG. 4.
Figure 5:
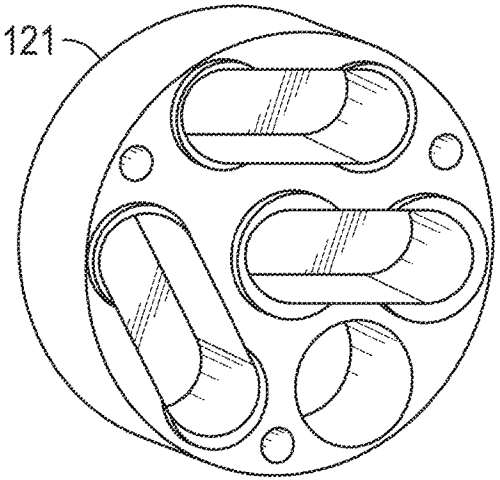
FIG. 5 is a rear perspective view of a first cap at the first end of the seven-pass tube bank of FIG. 4.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

An embodiment of the invention, as shown and described by the various figures and accompanying text, provides a system for heat transfer 100 adapted to transport cool regolith through a heat exchanger, heat the regolith dust, store the heated regolith for an amount of time, and then process the heated regolith where heat is removed and used as energy. Cooled regolith may be reintroduced to the system for reuse.

The system 100 may utilize compressed air to convey fine regolith particles 113 in a closed loop system of tubing and through a complete heat exchange loop where heat energy is introduced into the regolith 113 by a load 105 and then removed by an energy harvest process. The heat collected by the regolith 113 may be utilized in a similar manner to heat collected from solar energy while on planetary surfaces. By way of example, and not as a limitation, regolith 113 may be heated in situ to high temperatures and the heat energy may be stored for later use. The heat energy may be transferred to be used in an alternate process such as, by way of example, and not as a limitation, powering solar powered components during night cycles, generating electrical power, or the like.

The system 100 may utilize a compressor pump 101 to move air through the system tubing 102 as a pneumatic gas. The system tubing 102 may connect components in a closed loop system. Regolith dust 113 may be introduced into the air flowing through the system, or other pneumatic gas, using a regolith inlet 103, which may be, by way of example, and not as a limitation, a venturi eductor, volumetric feeder, or the like providing a passageway into the tubing 102. The regolith inlet 103 may be in fluid communication with system tubing 102 and may be positioned proximate a compressor outlet 112. Prior to introduction to the regolith inlet 103, the regolith 113 may be introduced to a storage hopper 111, which may be in fluid communication with the regolith inlet 103. A fine particle filter 109 may be located between an outlet of the storage hopper 111 and the regolith inlet 103. The storage hopper 111 may be in fluid communication with the closed loop system such that it receives regolith 113 separated by the cyclonic separator 107. In another embodiment, the storage hopper 111 may receive regolith 113 from a source external to the closed loop system and may introduce the regolith into the closed loop system through the regolith inlet 103.

The regolith dust 103 may be introduced into the initial pneumatic flow path and then flow through a seven-pass tube bank 104, which may be located inside of a resistive heater furnace or other load 105. The load 105 may heat the seven-pass tube bank 104 section of the system 100 up to temperatures of 600° C., which in turn may heat the regolith particles 113 as they pass through the seven-pass tube bank 104. The load 105 may be a piece of equipment that outputs heat energy during normal operation. The regolith 113 in the closed loop system may absorb the heat energy created by the load 105 and act as a coolant agent for the system.

The seven-pass tube bank 104 may include seven tubes 114, 115, 116, 117, 118, 119, 120 in fluid communication with one another and placed parallel to one another. A first cap 121 may be placed at a first end of the seven tubes 114. 115, 116, 117, 118, 119, 120. The first cap 121 may be configured to place a first end of one of the seven tubes 114 in fluid communication with the system tubing 102. The first cap 121 may also be configured to place the first ends of the tubes 115 and 116, 117 and 118, and 119 and 120 in direct fluid communication with one another. A second cap 122 may be placed at a second end of the seven tubes 114, 115, 116, 117, 118, 119, 120. The second cap 122 may be configured to place a second end of one of the seven tubes 120 in fluid communication with the system tubing 102. The second cap 122 may also be configured to place the second ends of the tubes 114 and 115, 116 and 117, and 118 and 119 in direct fluid communication with one another. Either or both of the first cap 121 and second cap 122 may be removable from the seven tubes 114, 115, 116, 117, 118, 119, 120. The cooperative configuration of the first cap 121, second cap 122, and seven tubes 114, 115, 116, 117, 118, 119, 120 may require the pneumatic gas to enter the seven-pass tube bank 104 through the first cap 121 and pass through the length of each tube before exiting the seven-pass tube bank through the second cap 122. This may extend the duration the regolith 113 carried by the pneumatic fluid is exposed to the heat of the load 105 and allow the regolith 113 to absorb adequate amounts of heat from the load 105.

After exiting the load 105, the pneumatic fluid with the regolith 133 may be carried by tubing 102 to a cyclonic separator 107, which may be used to remove the regolith 113 from the pneumatic gas flow and direct the regolith 113 to an energy harvest system 123. The energy harvest system 123 may include an energy transfer device 110, a storage hopper 111, and a valve 108. The energy harvest system 123 may be used to extract heat energy from the regolith 113. In some embodiments, the energy harvest system 123, may convert the heat energy of the regolith 113 into another form of energy, such as, by way of example and not as a limitation, electrical energy. Upon existing the cyclonic separator 107, the heated regolith 113 may be collected in a storage hopper 106. The storage hopper 106 may be insulated to conserve or maintain the heat energy carried by the regolith 113. A valve 108 may be in fluid communication with an outlet of the storage hopper 106 and may be operated to selectively open or dose the outlet of the storage hopper 106. When the valve 108 is in a closed position, regolith 113 may be retained in the storage hopper 106. When the valve 108 is in an opened position, regolith 113 may leave the storage hopper 106 and enter the energy transfer device 110.

In one embodiment, the energy transfer device 110 may include a helical tube coil, which may be submerged in a water tank. The helical tube coil may act as a calorimeter to measure the amount of heat energy transferred into the water tank via thermocouples placed within the tank. The calorimeter may simulate an end process for the regolith 113 heat transfer and measure the total heat energy transferred from the regolith 113 into the water. In one embodiment, the energy may not be transferred into a water tank, but may enter an energy transfer device 110, which may convert the heat energy held by the regolith 113 to another form of energy, including, but not limited to, electrical energy, and consumed by devices in electrical communication with the system 100.

Upon leaving the energy transfer device 110, the coded regolith 113 may again pass through the cyclonic separator 107 to deposit the regolith particles 113 in a final hopper 111. The air may then pass through a fine particle filter 109 before returning back to the inlet 103 of the compressor pump 101, completing the closed loop system 100. In one embodiment, the final hopper 111 may also be used to feed regolith 113 into the system at the regolith inlet 103. In another body a separate hopper or other device may be used to introduce regolith 113 into the closed loop system.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the description of the invention. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc., do not denote any order or importance, but rather the terms first, second, etc. are used to distinguish one element from another. Furthermore, the use of the terms a, an, etc. do not denote a limitation of quantity, but rather denote the presence of at least one of the referenced item.

That which is claimed is:

1. A system for heat transfer comprising:
- a compressor in fluid communication with a closed loop system;
- a regolith inlet in fluid communication with the closed loop system;
- a first storage hopper adapted to carry an amount of regolith and in fluid communication with the regolith inlet; and
- a load in fluid communication with the closed loop system between a compressor inlet a compressor outlet.

2. The system for heat transfer according to claim 1 further comprising:
- a cyclonic separator in fluid communication with the closed loop system between an outlet of the load and the compressor inlet.

3. The system for heat transfer according to claim 2 wherein the first storage hopper is in fluid communication with an outlet of the cyclonic separator.

4. The system for heat transfer according to claim 2 further comprising:
- an energy harvest system in fluid communication with an outlet of the cyclonic separator.

5. The system for heat transfer according to claim 4 wherein the energy harvest system comprises:
- a second storage hopper in direct fluid communication with the outlet of the cyclonic separator.

6. The system for heat transfer according to claim 5, wherein the second storage hopper is insulated.

7. The system for heat transfer according to claim 5 wherein the energy harvest system comprises:
- a valve in direct fluid communication with an outlet of the second storage hopper.

8. The system for heat transfer according to claim 4 wherein the energy harvest system comprises:
- an energy transfer device adapted to convert a heat energy of the amount of regolith to another form of energy.

9. The system for heat transfer according to claim 4 wherein the energy harvest system comprises:
- a helical tube coil.

10. The system for heat transfer according to claim 1 further comprising:
- a fine particle filter in fluid communication with the closed loop system.

11. The system for heat transfer according to claim 1 further comprising:
- a seven-pass tube bank in fluid communication with the closed loop system.

12. The system for heat transfer according to claim 11 wherein the seven-pass tube bank is located within the load.

13. The system for heat transfer according to claim 1 wherein the regolith inlet comprises a venturi eductor.

14. The system for heat transfer according to claim 1 wherein the regolith inlet comprises a volumetric feeder.

15. A system for heat transfer comprising:
- a compressor in fluid communication with a closed loop system;
- a regolith inlet in fluid communication with the closed loop system;
- a first storage hopper adapted to carry an amount of regolith and in fluid communication with the regolith inlet;
- a load in fluid communication with the closed loop system between a compressor inlet a compressor outlet;
- a cyclonic separator in fluid communication with the closed loop system between an outlet of the load and the compressor inlet; and
- an energy harvest system in fluid communication with an outlet of the cyclonic separator.

16. The system for heat transfer according to claim 15 wherein the first storage hopper is in fluid communication with an outlet of the cyclonic separator.

17. The system for heat transfer according to claim 15 wherein the energy harvest system comprises:
- a second storage hopper in direct fluid communication with the outlet of the cyclonic separator;
- a valve in direct fluid communication with an outlet of the second storage hopper; and
- an energy transfer device adapted to convert a heat energy of the amount of regolith to another form of energy.

18. The system for heat transfer according to claim 17 wherein the second storage hopper is insulated.

19. The system for heat transfer according to claim 15 further comprising:
- a seven-pass tube bank in fluid communication with the closed loop system.

20. A system for heat transfer comprising:
- a compressor in fluid communication with a closed loop system;

a regolith inlet in fluid communication with the closed loop system;

a load in fluid communication with the closed loop system between a compressor inlet and a compressor outlet;

a cyclonic separator in fluid communication with the closed bop system between an outlet of the load and the compressor inlet;

a first storage hopper adapted to carry an amount of regolith and in fluid communication with the regolith inlet and an outlet of the cyclonic separator;

an energy harvest system in fluid communication with an outlet of the cyclonic separator, wherein the energy harvest system comprises:

an insulated storage hopper in direct fluid communication with the outlet of the cyclonic separator, a valve in direct fluid communication with an outlet of the insulated storage hopper, an energy transfer device adapted to convert a heat energy of the amount of regolith to another form of energy, and a helical tube coil;

a fine particle filter in fluid communication with the closed loop system; and a seven-pass tube bank in fluid communication with the closed loop system and located within the load.

* * * * *